US008869883B2

(12) United States Patent
McGuire et al.

(10) Patent No.: US 8,869,883 B2
(45) Date of Patent: Oct. 28, 2014

(54) HORIZONTAL FRAC BALL INJECTOR

(75) Inventors: Bob McGuire, Meridian, OK (US); Danny Lee Artherholt, Asher, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 390 days.

(21) Appl. No.: 13/032,163

(22) Filed: Feb. 22, 2011

(65) Prior Publication Data

US 2012/0211219 A1 Aug. 23, 2012

(51) Int. Cl.

| | |
|---|---|
| ***E21B 33/068*** | (2006.01) |
| ***E21B 33/05*** | (2006.01) |
| ***F16L 55/46*** | (2006.01) |
| ***E21B 43/26*** | (2006.01) |

(52) U.S. Cl.

CPC ..... *E21B 33/05* (2013.01); *E21B 43/26* (2013.01)

USPC ..... 166/75.15; 137/268; 15/104.062

(58) Field of Classification Search

CPC ..... E21B 33/068; E21B 33/05; E21B 33/16; E21B 33/14; E21B 43/261; F16L 55/46; G01F 25/0015

USPC ..... 166/70, 75.15, 284; 137/268; 15/104.062

See application file for complete search history.

(56) References Cited

U.S. PATENT DOCUMENTS

| | | | | |
|---|---|---|---|---|
| 2,961,045 | A | 11/1960 | Stonger et al. | |
| 2,961,046 | A | 11/1960 | Moeller et al. | |
| 3,000,028 | A * | 9/1961 | Buie et al. | 15/104.062 |
| 3,011,196 | A * | 12/1961 | Glover | 15/104.062 |
| 3,028,996 | A * | 4/1962 | Ellett | 15/104.062 |
| 3,889,708 | A | 6/1975 | Chronister et al. | |
| 3,911,724 | A * | 10/1975 | Grove et al. | 73/1.17 |
| 4,111,334 | A | 9/1978 | Winn, Jr. et al. | |
| 4,132,243 | A * | 1/1979 | Kuus | 137/268 |
| 4,134,288 | A * | 1/1979 | Kim | 73/1.17 |
| 4,268,932 | A | 5/1981 | Hogan | |
| 4,359,797 | A | 11/1982 | Banks | |
| 6,302,199 | B1 | 10/2001 | Hawkins et al. | |
| 6,575,238 | B1 | 6/2003 | Yokley | |
| 7,571,773 | B1 | 8/2009 | West et al. | |
| 2003/0155114 | A1 | 8/2003 | Pedersen et al. | |
| 2005/0039925 | A1 | 2/2005 | Connell | |
| 2007/0068679 | A1 | 3/2007 | Robichaux et al. | |
| 2008/0087414 | A1 | 4/2008 | Robichaux et al. | |
| 2008/0223587 | A1 * | 9/2008 | Cherewyk | 166/386 |

FOREIGN PATENT DOCUMENTS

| | | |
|---|---|---|
| CA | 2703426 | 11/2010 |
| CN | 201537614 U | 8/2010 |

* cited by examiner

*Primary Examiner* — David Andrews

*Assistant Examiner* — Wei Wang

(74) *Attorney, Agent, or Firm* — Nelson Mullins Riley & Scarborough, LLP

(57) ABSTRACT

An injector spool supports a plurality of ball injector assemblies having respective ball cartridges adapted to load one frac ball at a time into a ball chamber of a ball launcher of the respective ball injector assemblies to provide a horizontal frac ball injector adapted to be connected to a frac head by frac iron.

11 Claims, 10 Drawing Sheets

HORIZONTAL FRAC BALL INJECTOR

RELATED APPLICATIONS

This is the first application filed for this invention.

FIELD OF THE INVENTION

This invention relates in general to equipment used for the purpose of well completion, re-completion or workover, and, in particular, to frac ball injectors used to inject or drop frac balls into a fluid stream pumped into a subterranean well during well completion, re-completion or workover operations.

BACKGROUND OF THE INVENTION

The use of frac balls to control fluid flow in a subterranean well is well known. The frac balls are generally dropped or injected into a well stimulation fluid stream being pumped into the well. This can be accomplished manually, but the manual process is time consuming and requires that workmen be in close proximity to highly pressurized frac fluid lines, which is a safety hazard. Consequently, frac ball droppers or injectors have been invented to permit faster and safer operation.

As is well understood in the art, multi-stage well stimulation operations often require that frac balls of different diameters be sequentially injected into the well in a predetermined size order that is graduated from a smallest frac ball to a largest frac ball. While frac ball injectors are available that can be used to inject single frac balls in any size order, such frac ball injectors require that a plurality of injector spools be vertically stacked to provide the required availability of frac balls of different diameters. The stacking of injector spools increases weight on the wellhead and raises working height, both of which are undesirable.

There therefore exists a need for a frac ball injector for use during well completion, re-completion or workover operations that does not raise working height or place extra weight on a wellhead.

SUMMARY OF THE INVENTION

It is therefore an object of the invention to provide a horizontal frac ball injector for use during multi-stage well completion, re-completion or workover operations.

The invention therefore provides a horizontal frac ball injector, comprising: an injector spool having an intake end, a discharge end and an axial passage that extends from the intake end to the discharge end; and at least two independently operated ball injector assemblies respectively connected to a radial port through a sidewall of the injector spool, each ball injector assembly supporting a ball cartridge having a capacity to accommodate a plurality of frac balls, and each ball injector assembly further comprising a ball launcher that is reciprocated by a ball launcher drive from a ball load position in which a ball is loaded from the ball cartridge into a ball chamber of a ball injector, to a ball release position in which the ball is moved out of a side opening of the ball chamber by fluid pumped through the axial passage.

The invention further provides a ball injector assembly of a horizontal frac ball injector, comprising: a ball cartridge that accommodates a plurality of frac balls; a ball launcher having a ball chamber sized to receive a one of the frac balls and a side opening from which the one of the frac balls is released from the ball chamber; and a ball launcher drive that reciprocates the ball launcher from a ball load position in which the one of the frac balls is loaded into the ball chamber to a ball release position in which the one of the frac balls is moved from the ball chamber by fluid pumped through an axial passage of the horizontal frac ball injector.

The invention yet further provides a horizontal frac ball injector adapted to be connected by frac iron to a frac head, comprising a ball injector spool having a plurality of ball injector mechanisms that respectively support a ball cartridge adapted to store a plurality of frac balls, each ball injector mechanism having a ball launcher reciprocated by a ball launcher drive from a ball load position in which a one of the frac balls is loaded from the ball cartridge into a ball chamber of the ball launcher and a ball release position in which the one of the frac balls is released from the ball chamber via a side opening in the ball chamber into an axial passage through the ball injector spool.

BRIEF DESCRIPTION OF THE DRAWINGS

Having thus generally described the nature of the invention, reference will now be made to the accompanying drawings, in which:

FIGS. 4*a*-4*d* are schematic diagrams of a ball injector of the injector assembly shown in FIG. 3, wherein FIG. 4*a* is a side elevational view of the ball injector; FIG. 4*b* is a top plan view of the ball injector; FIG. 4*c* is a rear end view of the ball injector; and, FIG. 4*d* is a front end view of the ball injector;

FIGS. 7*a*-7*d* are schematic diagrams of a ball injector of the injector assembly shown in FIG. 6, wherein FIG. 7*a* is a side elevational view of the ball injector; FIG. 7*b* is a top plan view of the ball injector; FIG. 7*c* is a rear end view of the ball injector; and, FIG. 7*d* is a front end view of the ball injector;

DETAILED DESCRIPTION OF THE PREFERRED EMBODIMENTS

The invention provides a horizontal frac ball injector for releasing frac balls of any required diameter into a fluid stream being pumped through the horizontal frac ball injector into a subterranean well. High capacity ball cartridges ensure that an adequate supply of frac balls of any required diameter is available for even the most complex well completion, re-completion or workover project. The horizontal frac ball injector is connected in line with a frac head or a high pressure valve using 1002 or 1502 frac iron. Conveniently, the horizontal frac ball injector can be left on a transport trailer, though it may be placed on the ground or any other appropriate platform prior to making up the frac iron connection. The horizontal frac ball injector is not mounted to the wellhead, so it does not raise working height and does not increase weight or stress on the wellhead.

Figure 1:
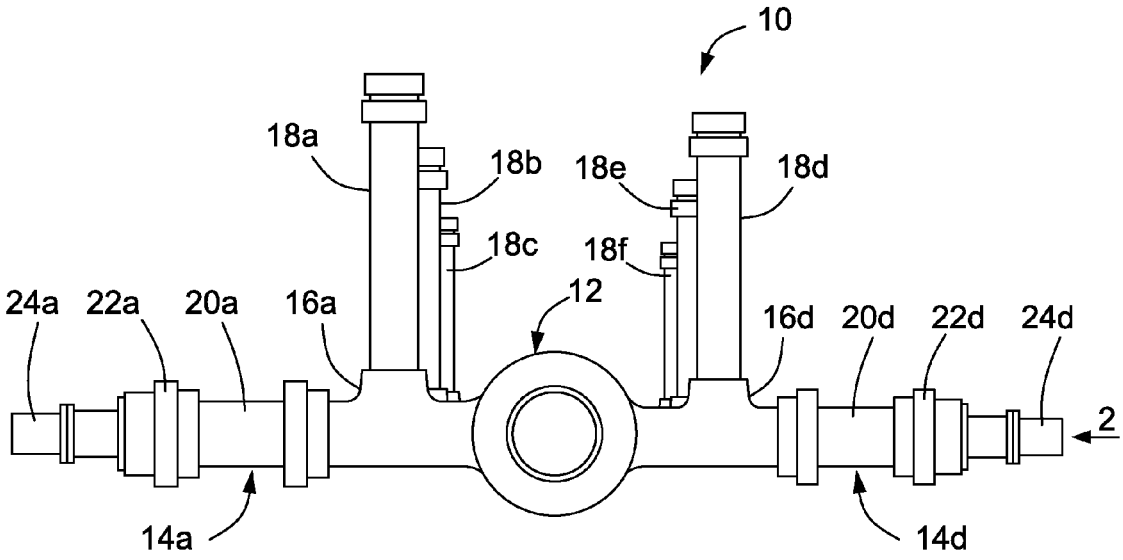
FIG. 1 is a schematic end elevational view of one embodiment of the horizontal frac ball injector in accordance with the invention.

FIG. 1 is a schematic end elevational view of the horizontal frac ball injector 10 in accordance with one embodiment of the invention. The horizontal frac ball injector 10 includes an injector spool 12 that supports a plurality of ball injector assemblies 14. In this embodiment the horizontal frac ball injector includes six ball injector assemblies, 14*a*-14*f*, only two of which, 14*a* and 14*d*, can be seen in front elevational view. Each ball injector assembly 14 includes a respective cartridge section 16*a*-16*f*, only two of which, 16*a* and 16*d*, can be seen in front elevational view. The respective cartridge sections 16 support a ball cartridge 18*a*-18*f*, seen in side elevation in FIG. 2. Each ball injector assembly 14 further includes a ball launch section 20*a*-20*f*, only two of which, 20*a* and 20*d*, can be seen; a pressure seal section 22*a*-22*f*, only two of which, 22*a* and 22*d*, can be seen; and, a drive section 24*a*-24*f*, only two of which, 24*a* and 24*d*, can be seen. In this embodiment, ball launch drive power is provided by motors, which may be hydraulic, pneumatic or electric motors, as will be explained below with reference to FIGS. 3-5. However, in another embodiment the ball launch drive power is provided by hydraulic or pneumatic cylinders, as will be explained below with reference to FIGS. 6-9.

Figure 2:
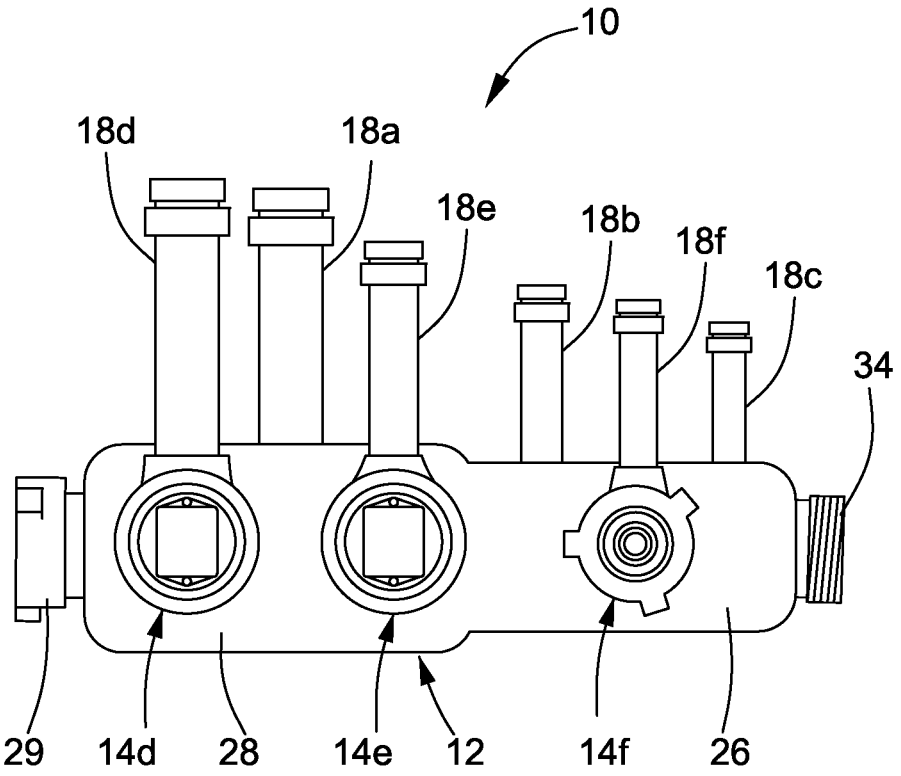
FIG. 2 is a schematic side elevational view of the horizontal frac ball injector shown in FIG. 1, taken from the side indicated by line 2 of FIG. 1.

FIG. 2 is a schematic side elevation view of the horizontal frac ball injector 10 shown from the direction indicated by line 2 of FIG. 1. The injector spool 12 includes a first section 26 with an intake end and a second section 28 with a discharge end. The second section 28 terminates at the discharge end in a wing-half 29 of a threaded union connector, to which an adapter is connected, as will be explained below with reference to FIG. 10. In this embodiment of the injector spool 12, the first section 26 terminates at the intake end in a 1002 or a 1502 union thread-half 34 to permit the connection of 1002 or 1502 frac iron in a manner well known in the art. It should be understood, however, that the first section 26 may terminate in either of a bolted flange a wing-half of a threaded union connector. The connection to the frac iron permits well stimulation fluids to be pumped through the horizontal frac ball injector 10, as will be explained below in more detail with reference to FIG. 10.

The first section 26 and the second section 28 respectively support three ball injector assemblies 14. The ball injector assemblies 14 that handle the larger diameter balls, for example 2¼-4½ inch balls, are mounted to a sidewall of the second section 28 in alignment with radial bores through the sidewall of the second section 28, as will be explained below with reference to FIG. 3. The ball injector assemblies 14 that handle the smaller diameter balls, for example ¾-2 inch balls, are mounted to a sidewall of the first section 26 in alignment with radial bores through the sidewall of the first section 26, as will be explained below with reference to FIGS. 6-9. The three radial bores in the sidewall of the first section 26 and the three radial bores in the sidewall of the second section 28 are axially offset and alternate in opposed radial planes that extend along opposite sides of the injector spool 12. However, the number and the spacing of the ball injector assemblies 14 on the injector spool 12 is a matter of design choice and three injector assemblies 14 on each section 26, 28 is shown by way of example only.

Figure 3:
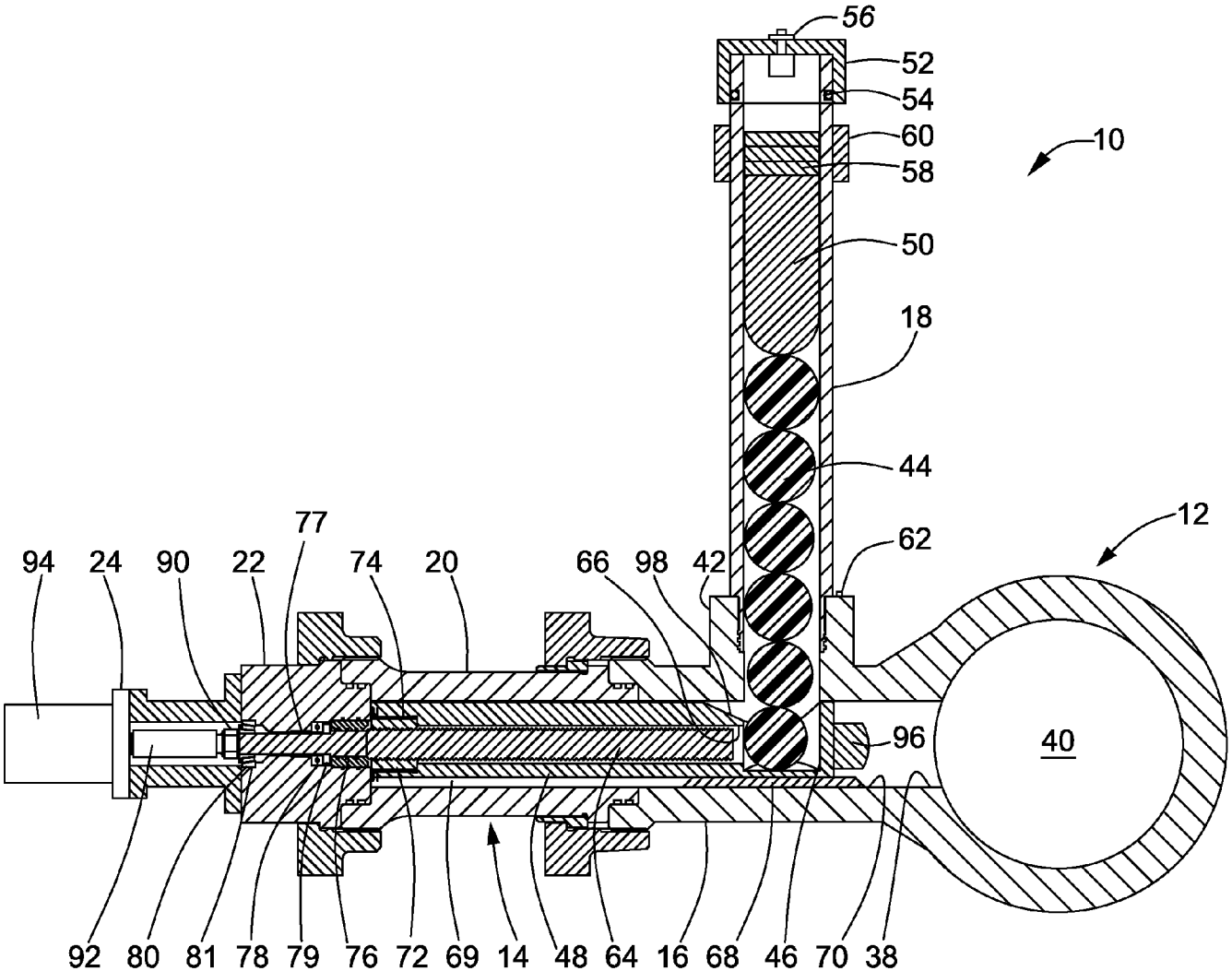
FIG. 3 is a schematic cross-sectional view of the horizontal frac ball injector and one injector assembly of the embodiment shown in FIG. 1.

FIG. 3 is a schematic cross-sectional view of the injector spool 12 and one ball injector assembly 14 of one embodiment of the horizontal frac ball injector 10 shown in FIGS. 1 and 2. The cartridge section 16 is welded, or threadedly connected, to the sidewall of the injector spool 12 in alignment with a radial bore 38 that communicates with an axial passage 40 that extends through the injector spool 12. The ball cartridge 18 is threadedly connected to a ball cartridge port 42 in a top of the cartridge section 16. In this embodiment, the ball cartridge port 42 supports the ball cartridge 18 perpendicular to a longitudinal axis of the injector spool 12, though this orientation is not essential. Although the perpendicular orientation of the ball cartridge 18 is convenient and practical as a design choice, it is only important that the ball cartridge be oriented so that frac balls 44 are sequentially loaded into a ball chamber 46 in a ball launcher 48 of the ball injector assembly 14. The ball cartridge 18 stores a plurality of commercially available frac balls 44, typically phenolic resin frac balls of a composition known in the art. The frac balls 44 are urged into the ball chamber 46 by a ball chase 50, which applies a gravitational force to the frac balls 44 in the ball cartridge 18. In one embodiment, the ball chase 50 is a bullet-shaped mass made of stainless steel. However, it should be understood that the ball chase 50 may be a compression spring or a mechanical drive that applies a force that urges the frac balls 44 into the ball chamber 46. A ball cartridge cover 52 provided with high pressure seals 54 seals a top end of the ball cartridge 18.

As understood by those skilled in the art, it is advantageous to have confirmation when a frac ball 44 has been released from the ball injector 48. Consequently, it is advantageous to provide a system that displays a relative position of the ball chase 50 within the ball cartridge 18. In accordance with one embodiment of the invention, the system that displays the relative position of the ball chase 50 within the ball cartridge 18 is a sonic transducer 56, an output of which is used to create a display on a ball injector control console (not shown). The display may provide a simple indication of a distance, for example in inches or centimeters, from a bottom of the sonic transducer to a top of the ball chase 50. Alternatively, a programmable circuit can translate the distance into a number of balls remaining in the ball cartridge using a simple algorithm within the knowledge of one skilled in the art.

In accordance with another embodiment of the invention, the system that displays the relative position of the ball chase 50 within the ball cartridge 18 is a laser range finder 62. In accordance with this embodiment, the ball cartridge 18 is constructed from a high tensile strength nonmagnetic material, such as copper beryllium, or the like. A rare earth magnet pack 58 secured to a top end of the ball chase 50 strongly attracts an external follower sleeve 60 sized so that a bottom edge thereof roughly coincides with the top end of the ball chase 50, though this relationship is a matter of design choice. The external follower sleeve 60 may be a magnetic material, such as steel, and/or contain embedded magnets oriented to be attracted to the magnet pack 58. The laser range finder 62 is mounted to a top of the ball cartridge port 42 and computes a distance to a bottom edge of the external follower sleeve 60. The distance may be displayed as a number of inches or centimeters, or translated into a ball count, that is displayed by on a display (not shown) of a control console, as explained above.

If the sonic transducer 56 is used to track the position of the ball chase 50, the top end of the ball chase 50 may be drilled and tapped with an acme thread, or the like, to accept a compatibly threaded end of a lifter rod (not shown) to permit the ball chase 50 to be removed when there is no fluid pressure on the injector spool 12, so that the ball cartridge 18 can be recharged with frac balls 44. If the magnet pack 58 is secured to the top of the ball chase 50, a magnetic lifting rod (not shown) may be used to lift the ball chase 50 out of the ball cartridge 18 for the same purpose, or a bore may be drilled through the magnet pack 58 to permit a threaded lifting rod to be used, as described above.

Figure 4C:
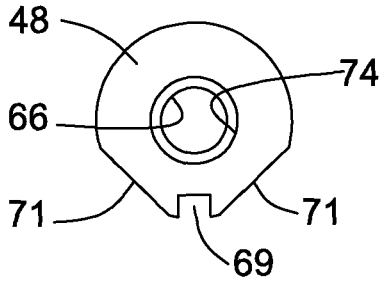
Figure 5:
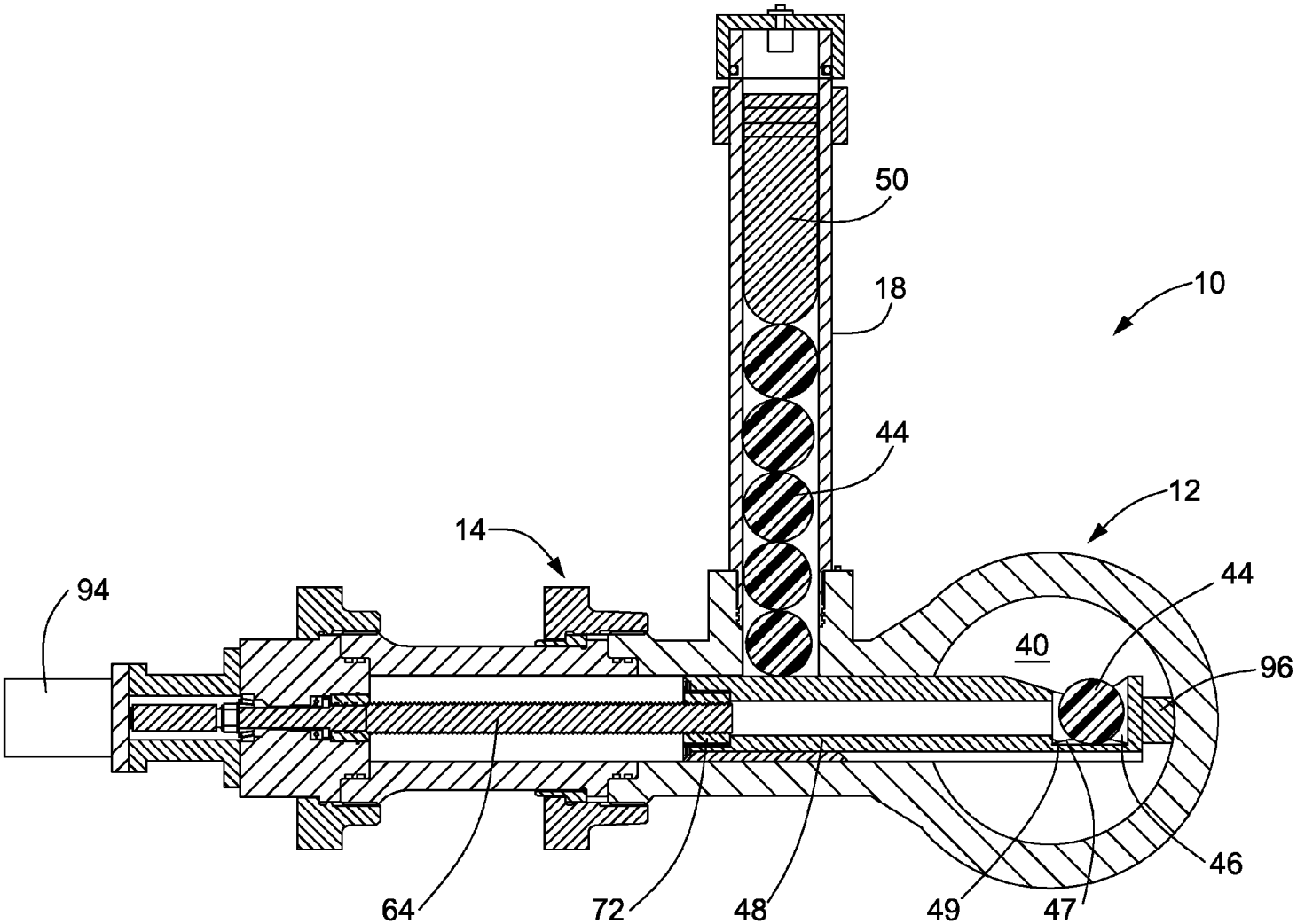
FIG. 5 is a schematic cross-sectional view of the horizontal frac ball injector shown in FIG. 3 releasing a frac ball into a fluid stream pumped through the horizontal frac ball injector.

The ball launcher 48 is reciprocated from a ball load position shown in FIG. 3 to a ball release position shown in FIG. 5 by a ball launcher drive. In one embodiment the ball launcher drive, as shown in FIG. 3, is a threaded drive rod 64, which extends into an axial bore 66 that is formed from a rear end of the ball launcher 48 to a rear side of the ball chamber 46. A guide key 68 received in a key way 69 that runs a full length of a bottom of the ball launcher 48 (see FIG. 4*c*) prevents the ball launcher 48 from rotating within a cylindrical bore 70 that extends from an outer end of the ball launch section 20 to an inner end of the cartridge section 16. The guide key 68 is machined into, affixed to, or built up on a bottom of the cylindrical bore 70 in the cartridge section 16.

The threads on the drive rod 64 are engaged by a compatibly threaded drive sleeve 72 immovably captured in a drive sleeve bore 74 in the rear end of the ball launcher 48. Rotation of the drive rod 64 translates to linear movement of the ball launcher 48 due to the compatible threads on the drive sleeve 72. A high pressure seal pack 76 prevents well and stimulation fluid pressure from escaping around the drive rod 64. The drive rod 64 is radially stabilized by a needle bearing 77 and axially stabilized a thrust bearing 78 that rides on a bushing 79 which abuts a step in the drive rod 64, and both axially and radially stabilized by a tapered roller bearing 80 received in a tapered bearing cage 81. A lock nut 90 threadedly engages an outer end of the drive rod 64 and locks the bearings 78, 80 in place. A drive shaft 92 connected to the outer end of the drive rod 64 and an output shaft of a motor 94 rotates the drive rod 64 in a direct relation to rotation of the output shaft of the motor 94. The motor 94 may be a hydraulic, pneumatic or an electric motor. A travel limiter 96 on an inner end of the ball launcher 48 ensures that the drive rod 64 cannot be disengaged from the drive sleeve 72, as will be explained below with reference to FIG. 5. As the ball launcher 48 is moved forward by the motor 94 from the ball load position to the ball release position shown in FIG. 5, a ball shunt ramp 98 forces all other frac balls 44 in the ball cartridge 18 upward to ensure that a frac ball resting on the frac ball 44 in the ball chamber 46 is not damaged as the ball launcher 48 is driven past the ball cartridge 18.

Figure 4A:
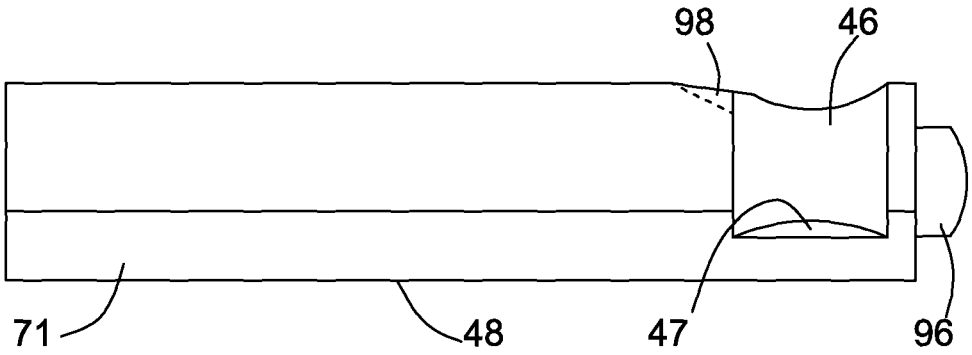
Figure 4B:
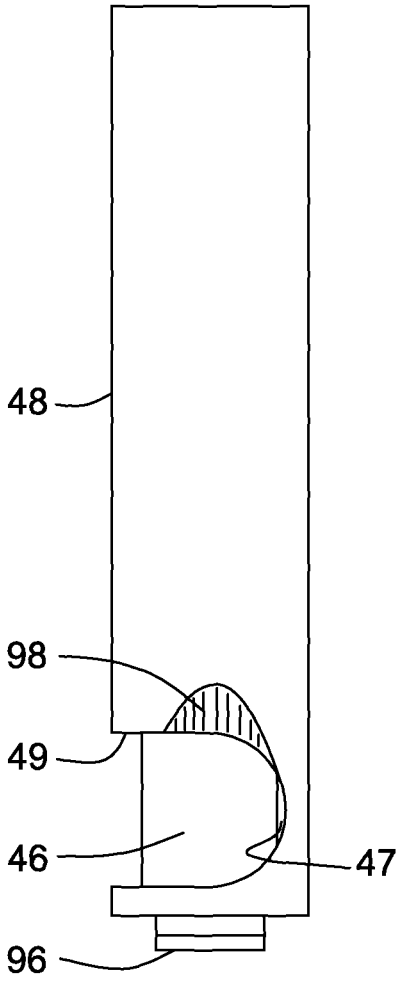
Figure 4D:
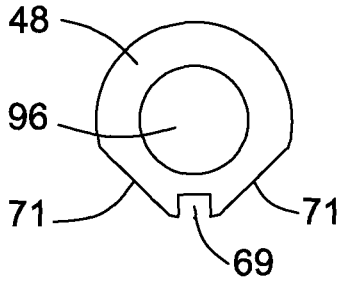

FIGS. 4*a*-4*d* are schematic diagrams of the ball launcher 48 of the injector assembly 14 shown in FIG. 3. FIG. 4*a* is a side elevational view of the ball launcher 48. As can be seen, the ball chamber 46 is a circular bore that extends downwardly through an inner end of the ball launcher 48, but does not extend completely through the ball launcher 48. The circular bore pierces longitudinal flats 71 on each side of the ball launcher 48, which forms a crescent-shaped opening 47 in one side of the ball chamber 46. The opposite side wall of the ball chamber 46 is machined away to form a side opening 49 through which the frac balls 44 are released from the ball chamber 46, as will be explained below with reference to FIG. 5. The ball shunt ramp 98 is only machined on the top side of the ball launcher 48, as can also be seen in FIG. 4*b* which is a top plan view of the ball launcher 48. FIG. 4*c* is a rear end view of the ball launcher 48 and FIG. 4*d* is a front end view of the ball launcher 48. As seen in FIG. 4*c*, the axial bore 66 and the drive sleeve bore 74 are concentric. As seen in FIGS. 4*c* and 4*d*, the key way 69 extends a full length of the ball launcher 48. The longitudinal flats 71 milled on each side of the key way 69 provide fluid passages to permit well stimulation fluid to flow around the ball launcher 48 as it is reciprocated from the ball load position to the ball release position. As also seen in FIG. 4*d*, in this embodiment the travel limiter 96 is a cylindrical boss having a front face that is contoured to mate with an inner wall of the axial passage 40 of the injector spool 12 shown in FIG. 3. However, the shape of the travel limiter 96 is a matter of design choice.

FIG. 5 is a schematic cross-sectional view of the injector spool 12 and the injector assembly 14 shown in FIG. 3 in the process of releasing a frac ball 44 into a fluid stream pumped through the axial passage 40 of the injector spool 12. As shown in FIG. 5, when the ball launcher 48 enters the axial passage 40 of the injector spool 12 a proportion of the fluid stream flows over the top wall of the ball chamber 46 and a proportion of the fluid flows through the crescent-shaped opening 47 in the ball chamber 46. This applies fluid pressure on the frac ball 44 to push the frac ball 44 through the side opening 49 of the ball chamber 46. As soon as the ball launcher 48 has moved far enough into the axial passage 40, the frac ball 44 is released from the ball chamber 46. In accordance with one embodiment of the invention, when the travel limiter 96 contacts the sidewall of the axial passage 40 a resulting resistance to further rotation of the drive shaft 64 causes a resistance-activated switch (not shown) to automatically reverse the motor 94, which retracts the ball launcher 48 to the ball load position shown in FIG. 3. In the ball load position, a next ball 44 in the ball cartridge 18 is urged into the ball chamber 46 by the ball chase 50. The same resistance-activated switch stops the motor 94 when the ball launcher 48 has returned to the ball load position. Of course the motor 94 can also be controlled manually by monitoring a resistance gauge that indicates a drive resistance of the motor 94, for example, a hydraulic or pneumatic pressure gauge or a voltmeter. The position of the ball chase 50, determined using one of the apparatus described above with reference to FIG. 3, gives a positive indication of whether the ball launcher 48 has been returned to the ball load position after a ball has been successfully released into the axial passage 40.

Figure 6:
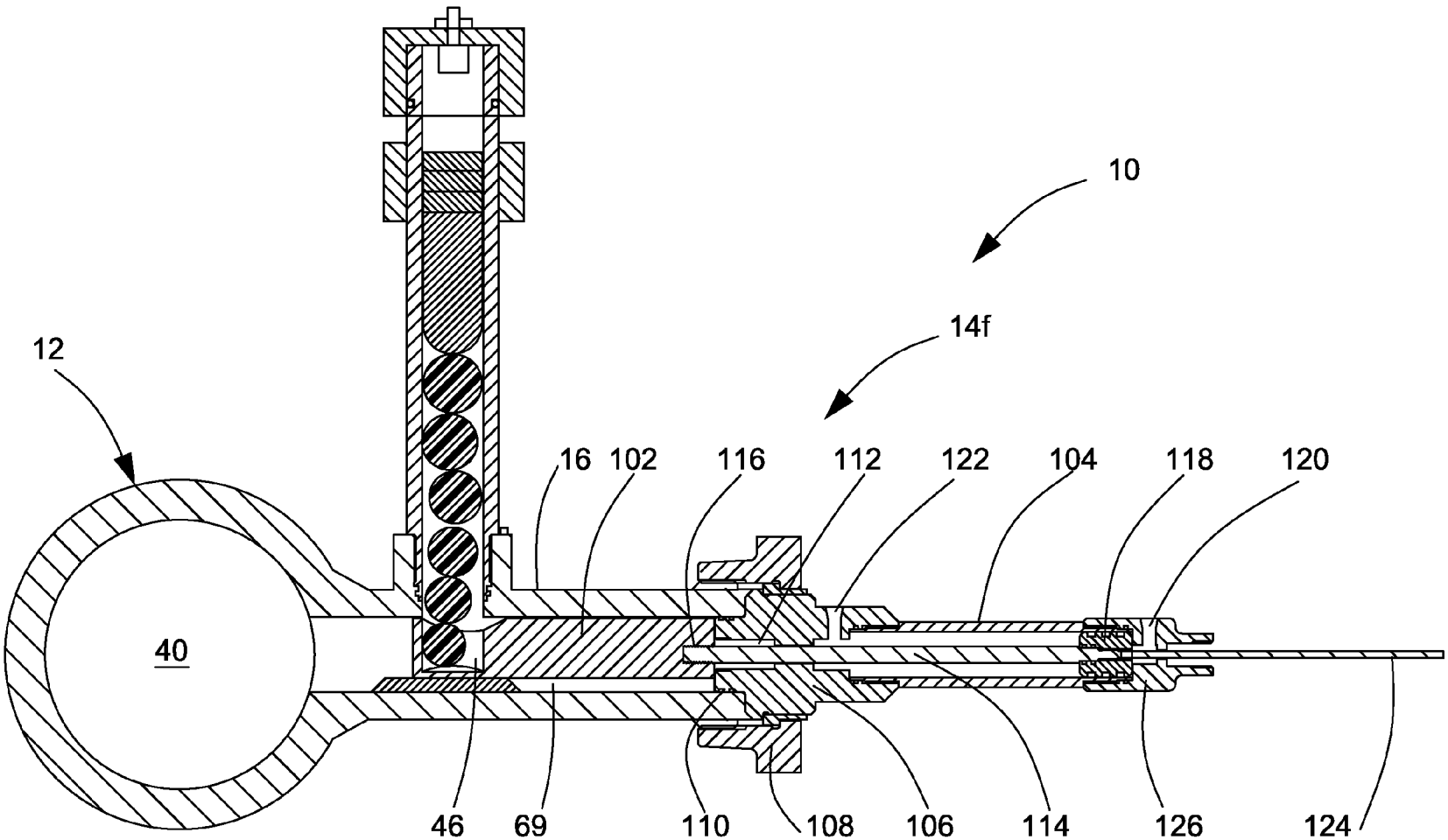
FIG. 6 is a schematic cross-sectional view of the horizontal frac ball injector and one injector assembly in accordance with another embodiment of the invention.

FIG. 6 is a schematic cross-sectional view of the injector spool 12 and one injector assembly 14*f* in accordance with another embodiment of the invention. The injector assembly 14*f* is identical to the injector assembly 14 described above with reference to FIG. 3 with the exceptions of the drive unit and minor differences in a ball launcher 102. The ball launcher 102 is reciprocated from the ball load to the ball release position by a hydraulic or pneumatic cylinder 104. The hydraulic or pneumatic cylinder 104 has an inner end 106 connected to the cartridge section 16 by a wing nut 108. O-ring seals 110 inhibit well stimulation fluid from escaping to atmosphere around the inner end 106. A high pressure seal pack 112 inhibits well pressure from entering the cylinder 104, and prevents leakage around a piston rod 114 that is affixed to a rear end of the ball launcher 102. In this embodiment, the piston rod 114 threadedly engages a threaded bore 116 in a rear end of the ball launcher 102. A piston 118 is reciprocated within the cylinder 104 by fluid injected (and drained, as appropriate) through respective ports 120, 122. A cylinder position indicator rod 124 connected to a rear side of the piston 118 provides a visual indication of a position of the piston 118. The cylinder position indicator rod 124 extends through fluid seals (not shown) supported by a cylinder end cap 126.

Figure 7A:
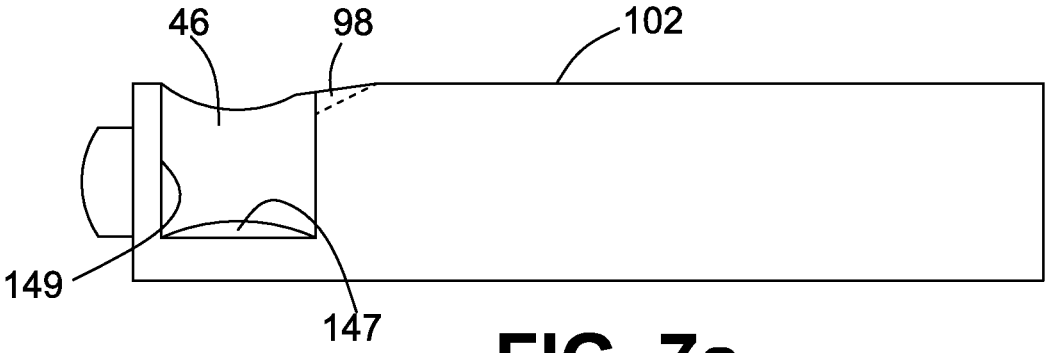
Figure 7B:
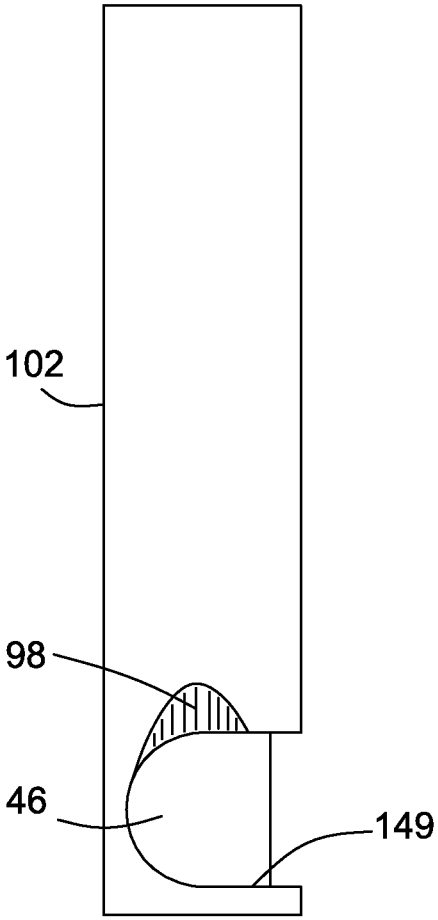
Figure 7C:
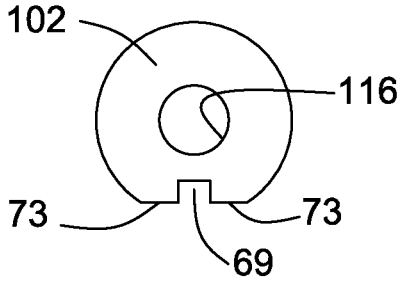
Figure 7D:
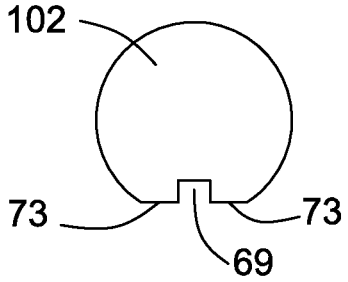

FIGS. 7*a*-7*d* are schematic diagrams of the ball launcher 102 of the injector assembly 14*f* shown in FIG. 3. FIG. 7*a* is a side elevational view of the ball launcher 102. As can be seen, the ball chamber 46 is a circular bore that extends downwardly through the ball launcher 102, but does not extend all the way through the ball launcher 102. The circular bore pierces the sidewalls of the ball launcher 102 near a bottom of the bore and creates a crescent-shaped opening 147. The opposite sidewall is machined away to create an open side 149 in the ball launcher 102. The ball shunt ramp 98 is only machined into the top side of the ball launcher 48, as can also be seen in FIG. 7*b* which is a top plan view of the ball launcher 102. FIG. 7*c* is a rear end view of the ball launcher 102 and FIG. 7*d* is a front end view of the ball launcher 102. The threaded bore 116 that accepts the piston rod 114 (FIG. 6) can be seen in FIG. 7*c*. As seen in FIGS. 7*c* and 7*d*, the key way 69 extends a full length of the ball launcher 102. Longitudinal flats 73 milled on each side of the key way 69 provide fluid passages to permit well stimulation fluid to flow around the ball launcher 102 as it is reciprocated from the ball load position to the ball release position.

Figure 8:
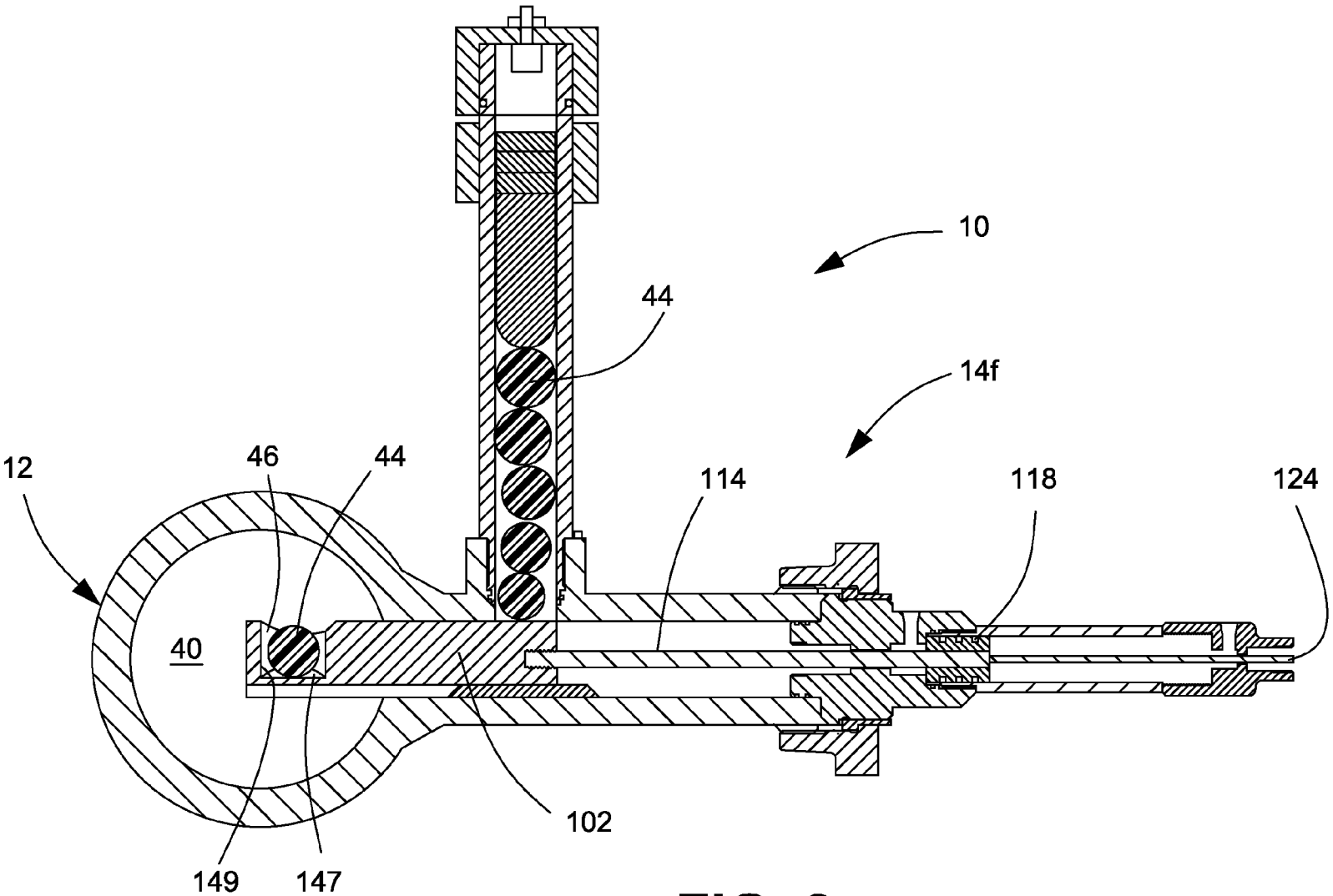
FIG. 8 is a schematic cross-sectional view of the horizontal frac ball injector shown in FIG. 6 releasing a ball into a fluid stream pumped through the horizontal frac ball injector.

FIG. 8 is a schematic cross-sectional view of the injector spool 12 and the ball launcher 102 shown in FIG. 6 in the process of releasing a frac ball 44 into a fluid stream pumped through the axial passage 40 of the injector spool 12. When the piston 118 is at the end of its stroke as shown, the piston rod 114 is fully extended and the ball chamber 46 in the ball launcher 102 is inside the axial passage 40 of the injector spool 12. Consequently, as explained above with reference to FIGS. 4*a*-4*d*, a proportion of the fluid stream flows over the top wall of the ball chamber 46 and a proportion of the fluid stream flows through the crescent-shaped opening 147 in the bottom of the ball chamber 46, which urges the frac ball 44 through the open side 149 of the ball chamber 46 and into the axial passage 40. The cylinder position indicator rod 124 visually indicates that the ball launcher 102 is in the ball release position.

Figure 9:
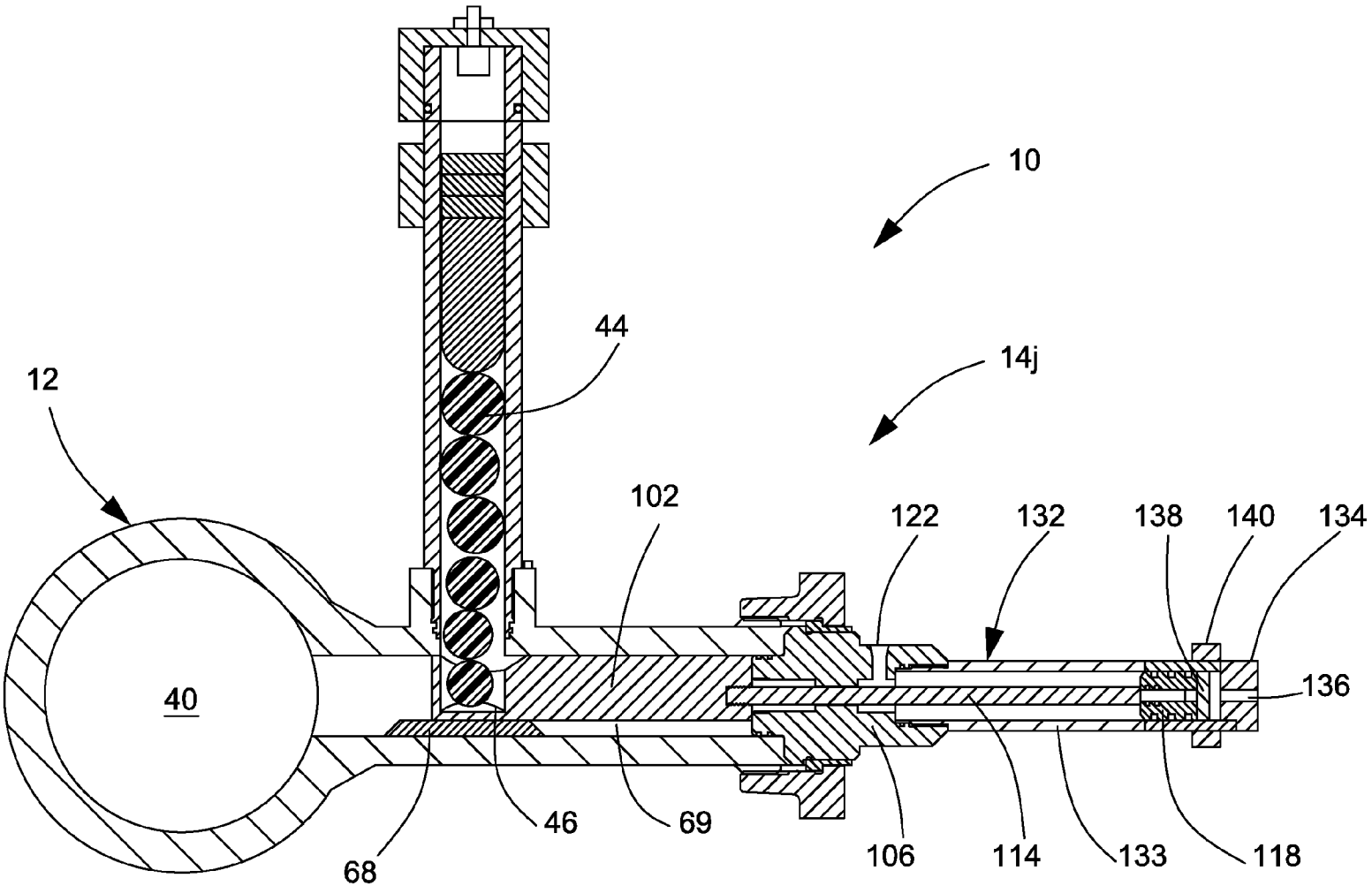
FIG. 9 is a schematic cross-sectional view of the horizontal frac ball injector and one injector assembly in accordance with yet another embodiment of the invention.

FIG. 9 is a schematic cross-sectional view of the injector spool 12 and one injector assembly 14*j* in accordance with yet another embodiment of the invention. The injector assembly 14*j* is identical to the injector assembly 14*f* described above with reference to FIGS. 6-8, with an exception that a hydraulic or pneumatic cylinder 132 of the injector assembly 14*j* does not include the cylinder position indicator rod 124 described above. Rather, the cylinder 132 of the injector assembly 14*j* has a non-magnetic cylinder wall 133, made from an aluminum alloy, or the like. A cylinder cap 134 on an outer end of the cylinder 132 includes a fluid injection port 136 through which fluid is injected, or drained, as required using a fluid line (not shown). A magnet or magnet assembly 138 is affixed to an outer end of the cylinder 118. A position indicator sleeve 140 has an inner diameter that permits the position indicator sleeve 140 to be easily reciprocated over the cylinder wall 133. The position indicator sleeve 140 is magnetically captured by the magnet 138. Consequently, the position indicator sleeve 140 continuously follows any movement of the piston 118, and provides a visual indication of a position of the piston 118, to permit an operator to visually follow movement of the piston 118.

Figure 10:
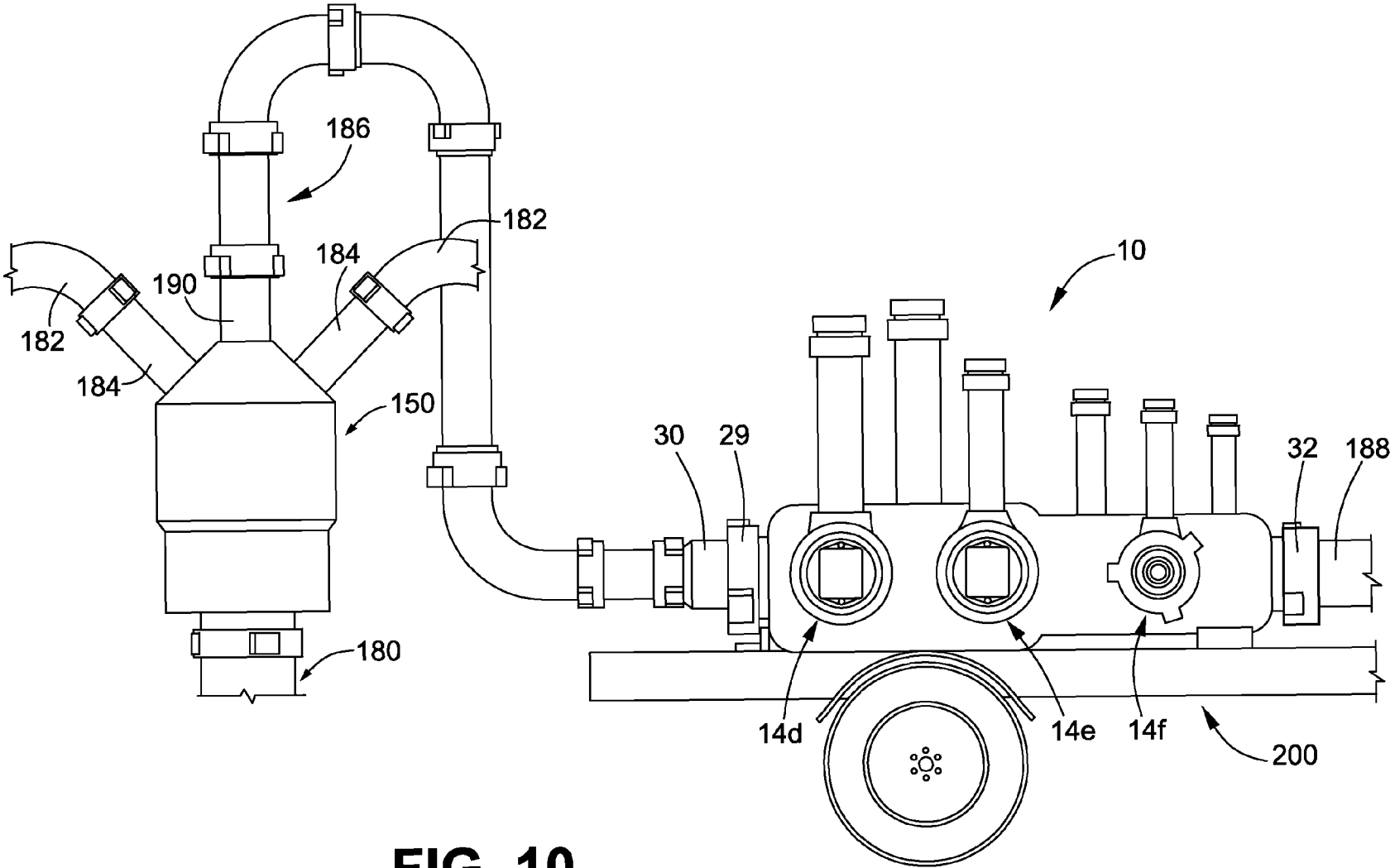
FIG. 10 is a schematic diagram of the horizontal frac ball injector shown in FIG. 2 connected by frac iron to a frac head set up for a multi-stage well stimulation operation.

FIG. 10 is a schematic diagram of the horizontal frac ball injector 10 shown in FIG. 2 connected by frac iron to a frac head 150 set up for a multi-stage well stimulation operation. The frac head 150, which may be a frac head of any known design or configuration, is mounted, for example, to a wellhead with a master control valve 180 in a manner known in the art. Frac irons 182, which are 1502 or 1002 frac iron, for example, are connected to well stimulation fluid injection ports 184 of the frac head. In this example, two well stimulation fluid injection ports 184 are shown for the sake of illustration. However, many frac heads are equipped with at least 4 well stimulation fluid injection ports 184. 1502 or 1002 frac iron 186 is also connected to a top port 190 of the frac head 150. The frac irons 186 are connected to an adapter 30 connected to the wing-half 29 of the threaded union (see FIG. 1) of the horizontal frac ball injector 10. The length and arrangement of the frac irons 186 is dictated by the well site, available space, and design choice, as understood by those skilled in the art. The connections shown are illustrative only. A wing-half 32 of a frac iron 188 is connected to the thread-half 34 of the horizontal frac ball injector 10 (see FIG. 1) to connect the horizontal frac ball injector 10 to a high pressure well stimulation fluid manifold (not shown) in a manner known in the art. During a well completion, re-completion or workover project, well stimulation fluid is pumped by high pressure pumps (not shown) through the manifold and the 1502 or 1002 frac irons 182 and 186 using procedures well known in the art. The frac balls 44 released into the fluid stream pumped through the horizontal frac ball injector 10 are carried by the fluid stream through the frac irons 186 and the frac head 150 into the well. It should be understood that the frac irons 186 may be custom built frac irons having an internal diameter of 5"-5.25" to permit large diameter balls to be injected for multi-stage well stimulations.

As seen in FIG. 10, the horizontal frac ball injector 10 may be hauled between job sites on a trailer 200 of any suitable design. The horizontal frac ball injector 10 is secured to the trailer 200 using appropriate blocking and straps, chains or the like (not shown) in a manner well known in the art. As a matter of convenience, the horizontal frac ball injector 10 may be left on the trailer 200 during the well stimulation procedure if space is available. Otherwise, the horizontal frac ball injector 10 may be removed from the trailer 200 and placed on the ground or any suitable skid or platform. Since the horizontal frac ball injector 10 is never mounted to the frac head 150, setup time is reduced, working height is lowered and no extra weight or stress is added to the wellhead.

The embodiments of the invention described above are only intended to be exemplary of the horizontal frac ball injector 10 in accordance with the invention, and not a complete description of every possible configuration. The scope of the invention is therefore intended to be limited solely by the scope of the appended claims.

We claim:

1. A horizontal frac ball injector, comprising:

an injector spool having an intake end, a discharge end and an axial passage that extends from the intake end to the discharge end; and at least two independently operated ball injector assemblies respectively connected to respective radial ports through a sidewall of the injector spool, each ball injector assembly supporting a ball cartridge having a capacity to accommodate a plurality of frac balls, and each ball injector assembly further comprising a ball launcher with a ball chamber having a sidewall, a bottom wall and a side opening in the sidewall, the ball launcher being reciprocated by a ball launcher drive from a ball load position in which a ball is loaded from the ball cartridge into the ball chamber, to a ball release position in which the ball launcher is moved into the axial passage and the ball is moved out of the side opening of the ball chamber by fluid pumped through the axial passage wherein the ball launcher drive comprises a motor that rotates a threaded drive rod which extends into an axial bore in a rear end of the ball launcher, the axial bore extending from a rear end of the ball launcher through a rear side of the ball chamber.

2. The horizontal frac ball injector as claimed in claim 1 wherein the threaded drive rod threadedly engages a threaded drive sleeve immovably affixed within the axial bore.

3. The horizontal frac ball injector as claimed in claim 1 wherein the ball cartridge comprises a ball chase that applies a force to a top ball in the ball cartridge to urge the frac balls into the ball chamber of the ball launcher, the ball chase being adapted to be engaged by a lifting rod to lift the ball chase from the ball cartridge so that the ball cartridge can be recharged with frac balls.

4. The horizontal frac ball injector as claimed in claim 3 wherein the ball cartridge comprises a cylinder of non-magnetic alloy with a high tensile strength.

5. The horizontal frac ball injector as claimed in claim 4 wherein the ball cartridge further comprises a magnet pack secured to a top end of the ball chase and a magnetic external follower sleeve that slides over an exterior of the cylinder in alignment with the magnet pack as the ball chase is displaced within the ball cartridge.

6. The horizontal frac ball injector as claimed in claim 5 further comprising a system that displays a relative position of the ball chase within the ball cartridge.

7. A ball injector assembly of a horizontal frac ball injector, comprising:

a ball cartridge that accommodates a plurality of frac balls;

a ball launcher having a ball chamber sized to receive a one of the frac balls, the ball chamber having a sidewall, a bottom wall and a side opening in the sidewall from which the one of the frac balls is released from the ball chamber; and a ball launcher drive that reciprocates the ball launcher from a ball load position in which the ball chamber is under the ball cartridge and the one of the frac balls is loaded into the ball chamber, to a ball release position in which the ball launcher is moved into an axial passage of an injector spool of the horizontal frac ball injector and the one of the frac balls is moved through the side opening of the ball chamber by fluid pumped through the axial passage wherein the ball launcher drive comprises a motor that rotates a threaded drive rod that threadedly engages a drive sleeve affixed in an axial bore through a rear end of the ball launcher, the axial bore extending from a rear end of the ball launcher through a rear side of the ball chamber.

8. The ball injector assembly as claimed in claim 7 wherein the ball cartridge comprises a ball chase that urges the frac balls into the ball chamber.

9. The ball injector assembly as claimed in claim 8 wherein the ball cartridge comprises a cylinder of non-magnetic material and the ball chase further comprises a magnet that strongly attracts an external follower sleeve which is slidably supported by the magnet on an outer side of the ball cartridge to provide a visual indication of a position of the ball chase within the ball cartridge.

10. The ball injector assembly as claimed in claim 7 wherein a top side of the ball launcher comprises a ball shunt ramp that is machined on a top side of the ball launcher, and the ball shunt ramp forces any other frac balls in the ball cartridge upwardly as the ball launcher is moved from the ball load position to the ball release position, to ensure that a frac ball resting on the frac ball in the ball chamber is not damaged as the ball launcher is moved from the ball load position to the ball release position.

11. A horizontal frac ball injector adapted to be connected by frac iron to a frac head, comprising a ball injector spool having a plurality of ball injector assemblies respectively connected to respective radial ports through a sidewall of the ball injector spool, the ball injector assemblies respectively supporting a ball cartridge adapted to store a plurality of frac balls, each ball injector assembly having a ball launcher with a ball chamber having a sidewall, a bottom wall and a side opening in the sidewall, the ball launcher being reciprocated by a ball launcher drive from a ball load position in which the ball chamber is under the ball cartridge and a one of the frac balls is loaded from the ball cartridge into the ball chamber, and a ball release position in which the ball chamber is in an axial passage of the ball injector spool and the one of the frac balls is released from the ball chamber via the side opening by fluid pumped through the axial passage of the ball injector spool, wherein the ball launcher drive comprises a motor that turns a threaded drive rod which engages a threaded drive sleeve affixed in an axial bore in a rear end of the ball launcher, and the ball launcher further comprises a key way that runs a full length of a bottom of the ball launcher and accepts a guide key of the ball injector assembly to prevent the ball launcher from rotating as the ball launcher is reciprocated from the ball load position to the ball release position.

* * * * *